United States Patent [19]

Bitko

[11] Patent Number: 4,943,690

[45] Date of Patent: Jul. 24, 1990

[54] POSITION INSENSITIVE SHOCK SENSOR WITH CLOSURE DELAY

[75] Inventor: Sheldon S. Bitko, E. Brunswick, N.J.

[73] Assignee: Fifth Dimension, Inc., Trenton, N.J.

[21] Appl. No.: 319,289

[22] Filed: Mar. 6, 1989

[51] Int. Cl.[5] ..... H01H 35/14

[52] U.S. Cl. ..... 200/61.47; 200/182; 200/186

[58] Field of Search ..... 200/61.47, 33 A, 186, 200/191, 211, 226, 227, 234, 61.52, 61.53, 220, 222, 182

[56] References Cited

U.S. PATENT DOCUMENTS

| | | | |
|---|---|---|---|
| 2,404,179 | 7/1946 | King | 200/61.47 X |
| 2,473,050 | 6/1949 | Camp | 455/96 |
| 3,177,312 | 12/1962 | Clarke | 200/61.45 R |
| 3,475,572 | 10/1969 | Voyentzie et al. | 200/61.45 R |
| 3,489,917 | 1/1970 | Gurol | 307/121 |
| 3,703,102 | 11/1972 | Prachar | 73/514 |
| 3,826,885 | 7/1974 | Allen et al. | 200/534 |
| 3,905,440 | 9/1975 | Okada et al. | 180/270 |
| 3,909,777 | 9/1975 | Baba et al. | 180/274 |
| 3,976,960 | 8/1976 | Bitko et al. | 335/58 |
| 3,978,301 | 8/1976 | Bitko | 200/220 |
| 4,099,040 | 7/1978 | Bitko | 200/220 |
| 4,135,067 | 1/1979 | Bitko | 200/61.52 |
| 4,158,191 | 6/1979 | Rogers et al. | 280/735 |
| 4,166,641 | 9/1979 | Okada et al. | 200/735 |
| 4,260,970 | 4/1981 | Bitko | 335/52 |
| 4,381,504 | 4/1983 | Bitko | 340/689 |
| 4,381,829 | 5/1983 | Montaron | 180/274 |
| 4,385,288 | 5/1983 | Bitko | 340/571 |
| 4,477,732 | 10/1984 | Mausner | 307/9.1 |
| 4,536,629 | 8/1985 | Diller | 200/61.45 R |
| 4,581,505 | 4/1986 | Bai et al. | 200/61.45 R |
| 4,608,468 | 8/1986 | Bai | 200/61.45 R |
| 4,641,041 | 2/1987 | Mattes et al. | 340/438 |
| 4,673,777 | 6/1987 | Bai | 200/61.45 R |
| 4,683,355 | 7/1987 | Bitko | 200/61.47 |
| 4,705,922 | 11/1987 | Seeger et al. | 200/61.45 M |

FOREIGN PATENT DOCUMENTS 2803781 10/1979 Fed. Rep. of Germany .

*Primary Examiner*—J. R. Scott

*Attorney, Agent, or Firm*—Burns, Doane, Swecker & Mathis

[57] ABSTRACT

A shock sensor has a mercury wetted insert for supporting a mercury mass normally spaced from a terminal or terminals. The mercury and the terminal or terminals are contained within a sealed housing. When the sensor is subjected to a shock, the mercury is redistributed and protrudes from the insert so as to make contact the terminal or terminals and complete a circuit. By providing a mercury-non-wettable surface ahead of the mercury wetted insert, a closure delay time or operation time is selectively set. Additionally, the porosity of various membranes within the housing can be preselected to vary the speed in which the mercury is redistributed and thus also adjust the closure delay time. Also, a constriction in the non-wettable surface ahead of the mercury wetted insert can be utilized to provide a time delay by introducing a dash-pot effect.

25 Claims, 3 Drawing Sheets

POSITION INSENSITIVE SHOCK SENSOR WITH CLOSURE DELAY

BACKGROUND OF THE INVENTION

I. Field of the Invention

The present invention relates to position insensitive shock sensors, and more particularly to position insensitive shock sensors using conductive liquids to complete an electric circuit. The shock sensor has particular utility in such diverse fields as auto air bag trigger circuits, emergency location transmitters (ELTs) for locating aircraft crash sites, and military ordnance fuses, for example.

II. Description of Related Art

There has been a variety of shock or acceleration sensors developed over the years which can be roughly divided into three categories. A first category typically involves a spring suspended weight. The weight may be suspended by a cantilever or a coil spring and when the system undergoes a rapid acceleration or deceleration (i.e. shock) the inertia of the weight causes the weight to be displaced in a direction counter to the force of the spring. When the shock exceeds a threshold level, the weight is displaced in the direction opposite the acceleration or deceleration and causes an electrical circuit to be completed.

A second category of shock sensors involves magnetically suspended weights. These types of shock sensors may involve weights which are magnetically attracted to a fixed magnet or might involve a moveable magnet and a fixed magnet wherein the like poles of the moveable magnet and the fixed magnet are adjacently positioned so that the magnets normally repel one another. When the shock sensors of the second category are subjected to a sufficiently large shock, the inertia of the weight overcomes the magnetic forces to move a fixed distance in order to cause an electrical contact closure for completing an electrical circuit.

A third category of shock sensors involves the use of an electrically conductive fluid as the weight. The conductive fluid typically comprises mercury but could alternatively comprise fine iron filings, conductive materials suspended in fluids, etc. In one type of conductive liquid shock sensor a mercury reservoir is enclosed in a glass tube, and wherein electrical contacts are adjacently disposed at one end of the glass tube. Among the disadvantages of that construction are its glass construction, which is susceptible to fracture, and the variability of friction between the mercury and the side walls, making the operation of the switch difficult to predict. Additionally, gas trapped between the mercury mass and the electrical contacts impedes the motion of the mercury, resulting in a high operating force for the switch. One further disadvantage is that the design constitutes a latching switch which requires that the switch be reset by applying a shock in the opposite direction of its normal operation.

An adjustable mercury switch has been proposed wherein the glass tube is tiltable relative to the anticipated direction of acceleration or deceleration. As the switch undergoes a shock, the mercury climbs uphill to close the electrical contacts. Although the threshold acceleration force required to operate the switch is easily adjusted by simply adjusting the relative tilt of the switch relative to the direction of the force, the switch is highly sensitive to a change in position, i.e., when the orientation of the overall system relative to the direction of the gravitational force is frequently varied, as when a shock sensor switch is installed in a car driven in a hilly environment. A ±5° change in angle can cause a ±25% change in the operating "G" level point.

A "G" level is defined as the dimensionless ratio of acceleration to the gravitational acceleration. Since $m=w/g$, where m is mass, w is weight and g is the acceleration induced by gravity, and $F=m \cdot a$, where F is force and a is acceleration, then $F=(w/g) \cdot a$. It is convenient to express acceleration of an object in terms of a multiple of g, i.e. the "G" level. Thus, if an object changes velocity at twice the gravitational acceleration g, it experiences a 2G force and the object will appear to weigh twice as much as it normally does in the g field.

A position insensitive shock sensor is disclosed in U.S. Pat. No. 4,683,355 issued to the present inventor on July 28, 1987 and is herein expressly incorporated by reference. Attached FIG. 1 shows such a shock sensor wherein a mercury wettable insert 234 supports a mercury mass 218 in spaced relationship to a first contact terminal 224. The shock sensor includes an electrically conductive base 220 in contact with an electrically conductive cover plate 212 to form a sealed housing. A mercury wettable tubular insert 234 is positioned inside of base 220. Mercury completely fills a bore of the tubular insert, except for the meniscus formed at each end of the insert 234. Gaskets 232 and 238, made from fibrous felt-like material or mesh that is gas permeable and somewhat mercury impermeable, axially space the insert 234 with respect to the end walls of base 220 and cover plate 212. The first contact terminal 224 is electrically isolated from the end wall of base 220. A second contact terminal 216 is connected to the cover plate 212 which in turn is connected to the base 220 that forms an electrical contact via radial protrusions 235 with the mercury wettable tubular insert 234. Thus, the second contact terminal 216 is in electrical communication with the mercury reservoir 218, so when the mercury makes contact with the first contact terminal 224 an electrical circuit is created. Until then, the mercury is held within the bore of the insert by surface tension.

The surface tension of a liquid is a force that causes a droplet of the liquid to assume a spherical shape in a zero gravity field. However, the shape and position of a body of liquid at rest and under conditions of constant pressure and temperature depend upon the equilibrium of three influences. These are (1) the surface tension of the liquid, (2) the magnitude and direction of all external forces, including gravity, acting on the liquid, and (3) the degree of wetting between the liquid and any solid surface in contact with the liquid.

A surface is considered to be wetted with a liquid if the liquid forms a low contact angle with the surface. A small quantity of liquid on a non-wetted surface will tend to bead, i.e. form a high contact angle, while on a wetted surface, the liquid will tend to spread itself uniformly over the wetted surface. In addition, as a result of a tilt or an impact, the liquid will leave a non-wetted surface without generating any restoring surface tension forces, whereas resisting forces will be present in the case of a liquid wetted to a surface.

When the shock sensor of FIG. 1 is subjected to a shock, the mercury is redistributed to protrude outwardly from the insert 234 to make contact with the first contact terminal 224 and thus close the electric circuit. Since the gaskets 232 and 238 are gas permeable, gas escapes from the protruding mercury, and does not impede the movement of the mercury. When the force of the shock subsides, the surface tension of the mercury causes the mercury to be retracted into the tubular insert 234.

While this mercury shock sensor overcomes many of the deficiencies of the previous switches, room for improvement remains. For example, the closure of the switch occurs virtually instantaneously in response to a shock in excess of a predetermined. value. However, in some cases a selectable closure delay, i.e. a delay in the operation time of the switch, would be desirable such as when the switch is to be introduced into a system in which an impact event or shock is to be distinguished from transitory vibrations. For example, if the switch is to be used in a vehicle air bag safety system, it is desirable to distinguish an actual crash event from the transitory vibration caused by running over potholes, emergency braking, etc. Similarly, if the switch is to be used in an emergency location transmitter (ELT), it would be desirable to distinguish between an actual crash event and transitory vibrations due to engine vibration, air turbulence, for example. If the shock sensor is to be used in a military ordnance fuse, it is highly desirable to distinguish between the impact of the ordnance on its target and the jostling that the ordnance may undergo during transportation. Absent the knowledge of how to create a closure delay in the shock sensor switch itself, additional electronic timing elements, such as disclosed in U.S. Pat. 4,477,732, would be required in order to achieve such a delay.

Further room for improvement in the FIG. 1 sensor remains in connection with a potential loss of mercury during certain switching conditions. In that regard, the mesh or screen of the FIG. 1 mercury switch sensor is mercury impermeable under normal operating conditions such as when the loading force on the mercury is perpendicular to the plane of the mesh, i.e., when the direction of the loading force coincides with the axis of the bore of the insert 234. This is so because the spaces between the woven wires of the mesh are small enough that the capillary repulsion caused by the mercury non-wettable nature of the wire mesh and the surface tension of the mercury prevents the mercury from passing through the mesh. As the mercury is forced against the mesh, the mercury protrudes somewhat into the mesh. The capillary attractive forces of the mercury cause the mercury to "ball" as much as possible. The balling of the mercury causes frictional forces to develop which resist passage of the mercury through the screen.

If the loading force is great enough to overcome the frictional forces, however, the mercury will pass through the mesh and reform into a ball on the other side. The size of the interstices is selected to minimize that occurrence. However, the size of the interstices varies according to the perspective or relative orientation of the load. In the axial direction the mercury "sees" the smallest apparent interstices, so the mesh is virtually mercury impermeable. Under other orientations of the load, such as loads oriented at 45° to the plane of the mesh, the mercury "sees" much larger interstices. Thus, when the shock sensor is subjected to side-loading (i.e. the "G" force developing in a direction perpendicular to the switch axis), the mercury faces relatively larger interstices and may be able to escape through the screen under otherwise normal operating conditions.

Additional considerations involving the FIG. 1 switch involve the fact that the outer casing or base 220 is made of an electrically conductive material and forms part of the overall circuit into which the switch is incorporated. Thus, care must be taken when positioning the switch to ensure that the switch does not short itself or other adjacent circuitry by inadvertently making contact with other conductive surfaces. Further, the requirement that the base 220 be made of an electrically conductive material restricts the types of materials and manufacturing processes which might be used in producing the switch.

SUMMARY OF THE PREFERRED EMBODIMENTS OF THE INVENTION

The present invention involves a shock sensor comprising a housing and a container disposed in the housing. The container has an inner surface which defines an axially extending chamber for containing an electrically conductive fluid such as mercury. A gas passage is disposed at one end of the chamber, which passage is gas permeable and conductive fluid-non-permeable. The inner surface of the container includes first and second axially adjacent zones. The second zone is disposed between the first zone and the gas passage means. The first zone is conductive fluid-wettable and the second zone is conductive fluid-non-wettable, whereby the conductive fluid is normally contained in the first zone when the sensor is free of shocks. At least one electrically conductive contact terminal is disposed in the chamber and is arranged to be contacted by the conductive fluid in response to the housing being acted upon by a shock at or above a threshold value. The terminal is spaced axially from the first zone whereby second zone provides means for delaying contact closure by the conductive fluid.

Preferably the gas passage is defined by a membrane disposed at the end of the container, which membrane is gas permeable and conductive fluid-non-permeable. By varying the gas porosity of the membrane, e.g., by compressing the membrane, the contact closure time can be further regulated.

By providing a constriction in the path of travel of the mercury, the contact closure time can be further regulated.

BRIEF DESCRIPTION OF THE DRAWINGS

These and other features of the present invention will become apparent by reference to the following detailed description in conjunction with the several views of preferred embodiments thereof illustrated in the attached drawings.

DETAILED DESCRIPTION OF THE PREFERRED EMBODIMENTS

Figure 1:
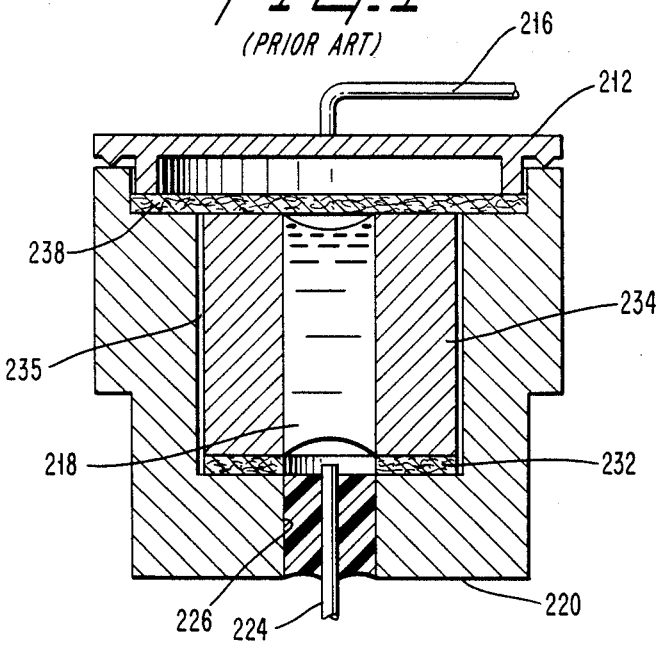
Fig. 1 (PRIOR ART)
FIG. 1 is a longitudinal sectional view of a prior art position insensitive shock sensor.
Figure 2:
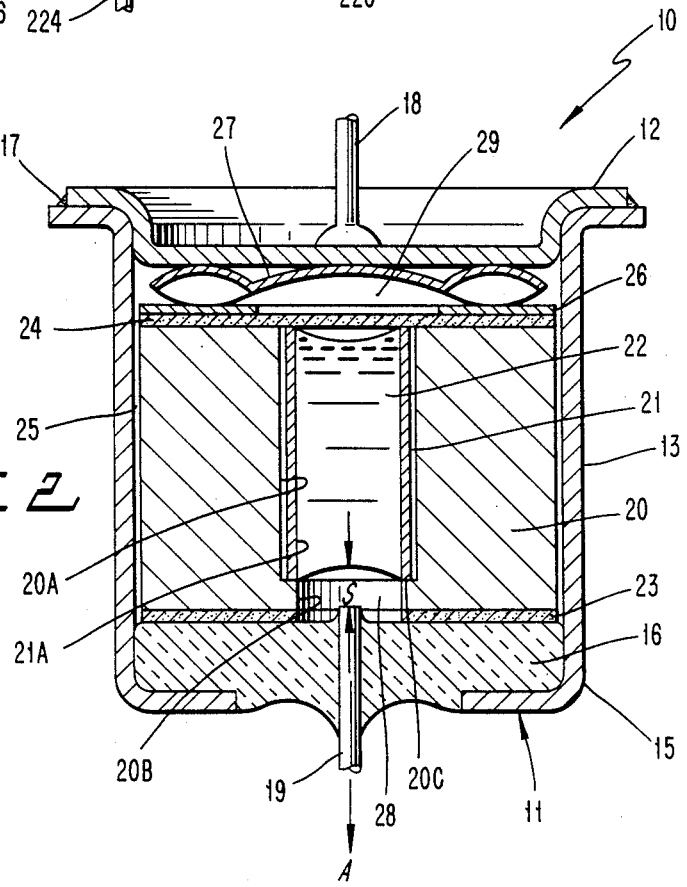
FIG. 2 is a cross-sectional view of a first embodiment of the shock sensor according to the present invention.
Figure 3:
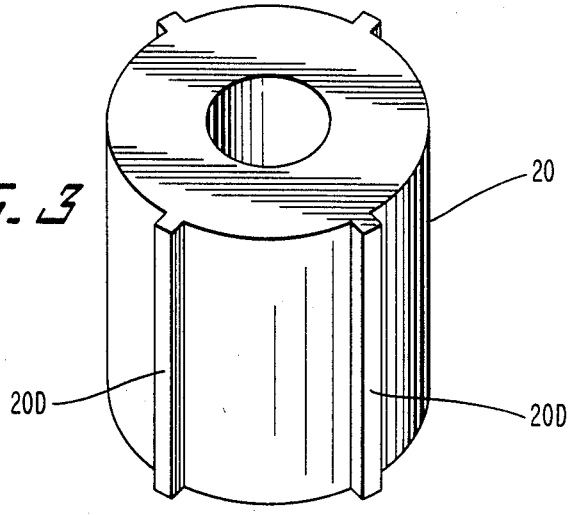
FIG. 3 is a perspective view of an insert used in the shock sensor according to the present invention.

Referring now in detail to the drawings, wherein like parts are designated by like reference numbers throughout, a first preferred embodiment of the shock sensor 10 according to the present invention is depicted in FIG. 2.

Throughout the detailed description, reference to shocks includes shocks caused by either rapid acceleration or deceleration.

The shock sensor 10 has a housing 11 comprised of a mercury-non-wettable, electrically conductive material, such as steel, and is capable of conducting a charge from a first terminal 18 connected to the outside of the housing 11 to the interior of the housing 11. The housing 11 includes a cover 12 and a body 13. The body 13 includes a metal can 15 and a seal header assembly in the form of a glass bead 16. The glass bead 16 electrically isolates a second terminal 19 from the conductive material housing and is neither electrically conductive nor wettable by the mercury.

A mercury-non-wettable, electrically conductive hold insert 20 is mounted in an electrically conductive engagement with the interior of the housing 11. The electrically conductive engagement may be manifested by crimping the housing 11 against at least one outwardly projecting flange 20D of the hold insert 20 to form a low impedance connection. The hold insert 20 is tubular and functions to spatially separate a mercury-wettable, electrically conductive insert or mercury carrier 21 from the end face of terminal 19. The hold insert 20 is provided with two coaxial cylindrical surfaces 20A, 20B on the interior thereof, and a corresponding stepped surface 20C interconnecting the concentric surfaces. The concentric cylindrical surface 20A receives the tubular mercury carrier 21. The hold insert 20 is formed of any suitable mercury-non-wettable material, whereby the concentric surface 20B defines a mercury-non-wettable zone which serves to spatially separate the mercury 22 from the contact terminal 29 by a selected distance S. As will be explained in detail below, the distance S creates a closure delay the extent of which is a function of the axial length of the surface 20B. The mercury carrier 21 is in an electrically conductive engagement with hold insert 20.

The mercury carrier 21 is formed of a mercury-wettable material, whereby an inner surface 21A thereof forms a mercury-wettable zone that is filled with mercury except for meniscuses formed at the axial ends thereof. Preferred materials for the mercury carrier 21 include the commercially available alloy Monel TM, nickel-copper or nickel-platinum alloys but could be any other compatible mercury wettable material.

The cover 12 is attached to the body 13 by a welded interface 17, or by other suitable means. The entire housing 11 is hermetically sealed and may be filled with pressurized gas, which fills the voids within the sensor 10. The gas may be an inert gas, such as hydrogen or argon for example, or the gas may be a tracer gas, such as helium, or a mixture thereof. The tracer gas facilitates testing for leaks in the hermetically sealed housing 11, particularly during the manufacturing process.

The hold insert 20 is spatially separated from the glass bead 16 via a front membrane 23. The hold insert 20 is spatially separated from the cover 12 by a rear membrane 24, a hold-down washer 26 and a wave washer 27. The membranes 23 and 24 are gas permeable (i.e., gas transparent) and mercury impermeable, preferably being made from organic substances such as urethane, teflon, or other materials which can be made sponge-like. That is, the materials are formed into sponge-like films having water interspersed therein. The water is thereafter removed, leaving behind a porous membrane.

The hold insert may include a series of radially outwardly projecting flanges 20D which may transmit electric current and define gas flow passages 25 between the hold insert 20 and the metal can 15, to permit gas to flow from the chamber 28 located ahead of the mercury 22, through the front membrane 23, gas flow passage 25 and rear membrane 24, into a rear chamber 29, and vice-versa. Accordingly, the mercury 22 can shift its position relatively uninhibited by pressure graduations which would otherwise be generated by a trapped gas.

When the shock sensor 10 is decelerated quickly while travelling forwardly in the direction of arrow A, or is subject to a similar shock, there will be exerted on the mercury a force acting in the direction of arrow A. That force coacts with gravity to protrude the mercury 22 from the mercury carrier 21. As the mercury 22 enters the front chamber 28, the gas present therein is pushed through the front gas permeable membrane 23, through the gas flow passage 25 located between the metal can 15 and the hold insert 20, through the rear gas permeable membrane 24 and into the rear chamber 29.

If the deceleration or shock is greater than a predetermined value, the mercury 22 will contact the second terminal 19, thus completing a circuit from the first contact terminal 18, through the cover plate 12, the metal can 15, the hold insert 20, the mercury carrier 21, and the mercury 22 to the second contact terminal 19. After the shock has dissipated, the mercury 22 is retracted back into the insert 21 by means of the surface tension forces: of the mercury 22, thus breaking the circuit.

Both the length L and the diameter d of the surface 21A of the carrier 21 govern the magnitude of the force required for protruding the mercury from the carrier. Since the weight of the mercury acts to extend the mercury and the surface tension acts to restrain the mercury, the propensity of the mercury to extend from the insert is normally balanced between the weight and the surface tension during non-shock conditions. (The weight of the mercury is proportional to the inside diameter d of the mercury carrier 22 squared times the length L of the mercury carrier, while the surface tension is essentially proportional to the diameter d of the mercury carrier 22).

Thus, as explained in U.S. Pat. No. 4,683,355, as the diameter d of the mercury carrier increases, the weight of the mercury increases exponentially (e.g. $w \sim d^2$), while the surface tension increases linearly. Therefore, the force required for the mercury to protrude from the carrier decreases as the carrier diameter increases. Since the weight of the mercury increases linearly with the length L of the insert, and the length L of the insert does not affect the surface tension, the force required to cause protrusion of the mercury decreases as the length of the insert increases. Accordingly, for sensitive shock sensors intended to sense small shocks, the insert diameter d and the length L would be made larger than those of the insert intended to sense greater shocks. The volume of the mercury can be so adjusted that, in a 1G field, gravity redistributes the volume such that the mercury protrudes from the mercury carrier and is in contact with the terminal 19, and when the gravity field is reduced below a predetermined threshold, surface tension of the mercury retracts the mercury off the first contact terminal. This would provide a normally closed switch which would open when exposed to acceleration less than 1.0G.

If the sensor 10 is subjected to a shock in a direction other than the direction of arrow A, only the component of the force in the direction of arrow A acts to close the switch, the component being defined by a cosine law function. Thus, the effective force of the shock is proportional to the actual force multiplied by the cosine of the angle formed between the direction of the shock force and arrow A, i.e. the axial line of the shock sensor. Therefore, the shock sensor displays a operating characteristic correlatable to a cosine law function.

The pre-selected distance S provided in accordance with the present invention between the mercury 22 at rest and the contact terminal governs the contact closure time. That is, the presence of the mercury non-wettable surface 20B enables a selected contact closure time delay to be established.

Figure 6:
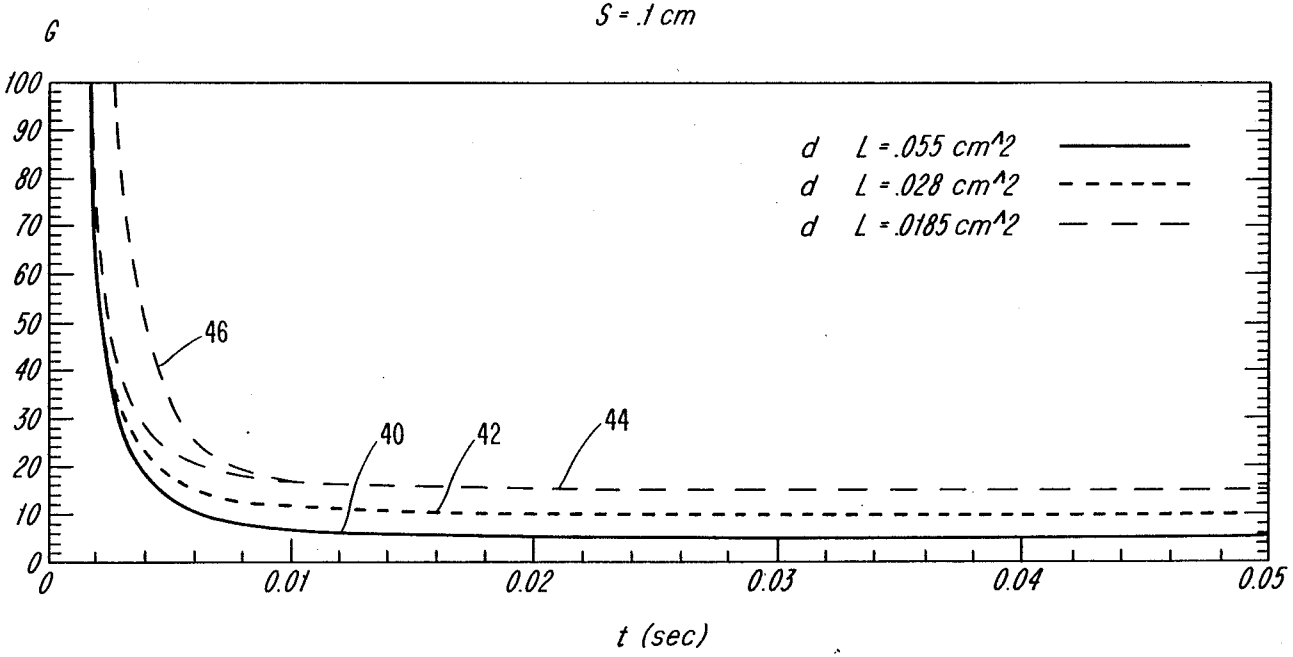
FIG. 6 discloses a graphical representation of examples of the contact closure time of the several embodiments of the invention.

FIG. 6 discloses typical possible curves of the threshold shock values G verses contact closure time produced by a computer model that has been programmed so that for any given two points of threshold acceleration value and contact closure time, an operating curve can be modeled to suit a specific need. As is evident from FIG. 6, the shock sensor displays an exponentially dependant operating characteristic. Characteristic curves 40, 42, and 44 depict the response of a typical switch having the indicated dimensions, operated in a 5G field, a 10G field, and a 15G field, respectively, and a curve 46 which depicts the switch response in a 15G filed with a larger S value (e.g. 0.5 cm). The graph illustrates that the larger the value of S, the longer the contact closure delay.

The closure delay time can also be varied by adjusting the gas permeability of the membranes 23, 24. That is, by selecting the pore size, or by varying the pore size by compressing the membranes 23 and 24 within the can 15, a predictable pressure graduation is created in opposition to the protrusion of the mercury 22 from the mercury carrier insert 21, which diminishes the mercury travel speed and thereby causes the sensor switch to display a predictable closure delay.

The membranes 23 and 24 are selectively compressible by controlling the compressive force exerted on the membranes 23 and 24 by the wave washer 27 or by selecting the appropriate spacing and size of the wave washer 27 relative to the other interior components and dimensions. Under compression the pore size may be reduced to half its normal value. The stainless steel screens of the prior art are virtually incompressible, and therefore the size of the interstices cannot be substantially altered by compressive forces.

Advantageously, the membrane material does not permit the escape of mercury through its pores when the shock sensor is subjected to side-loading as is the case with the metal mesh gaskets. The membranes display substantially uniform pore size with reference to any orientation, either axial or transverse. Because the pore size is substantially uniform, the mercury does not have the opportunity to escape through the membrane when the system is subject to side-loading. The membranes preferably have pore volume from 40–90% and pore diameters usually from 0.5–25 microns (but even as low as 0.1 for extended time delay applications) and the specific values of pore volume and pore diameter are selected be choosing the appropriate material and/or by controlling the membrane manufacturing process.

Figure 4:
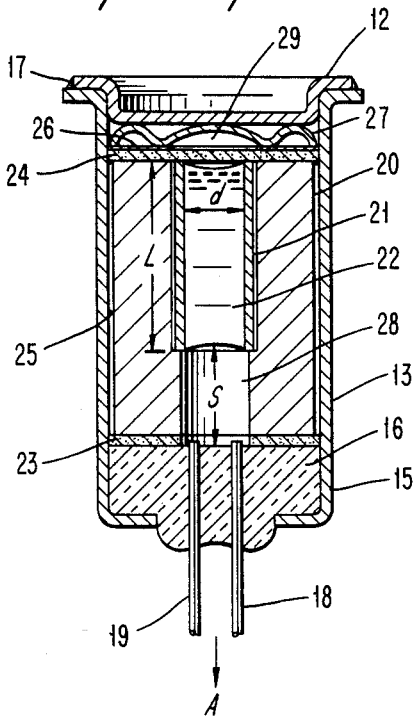
FIG. 4 is a longitudinal sectional view of a second preferred embodiment of the shock sensor according to the present invention.

FIG. 4 is a longitudinal sectional view of a second preferred embodiment of the invention describing a modified arrangement of the contact terminals 18 and 19. That is, those terminals are adjacently disclosed in the glass bead 16 at one end of the housing 11. When the shock sensor 10 is decelerated quickly while travelling in the direction of arrow A, or is subjected to a similar shock, then a force is exerted on the mercury in a direction of arrow A. That force coacts with gravity to protrude the mercury 22 from the mercury carrier 21. As the mercury 22 enters the front chamber 28, gas present therein is forced through the front gas permeable membrane 23, through the gas flow passage 25 between the can 15 and the insert 20, and through or around the rear gas permeable membrane 24 and into the rear chamber 29.

If the deceleration or shock is greater than a predetermined value, the mercury 22 will make contact with both the first contact terminal 19 and the second contact terminal 18 after a delay produced by the selected distance S, thus completing a circuit from the first contact terminal 19, through the mercury 22 into the second contact terminal 18.

One advantage of the second embodiment is that the can 15 and the inserts 20, and 21 can be made of an electrically insulative material, because no electrically conductive connections need be made between the can 15 and the inserts. Since the housing 11 does not form any part of the circuit, the shock sensor of FIG. 4 does not carry with it the risk of electrically shorting itself, or any portion of an adjacent circuit in the event of the housing 11 conductive materials, i.e. molded plastic, is that one can vary the dimensions of the hold insert 20 readily at a nominal cost. Thus, the diameter d, and length L of the mercury carrier 21 and the distance S can be easily changed to accommodate the specific needs.

Figure 5:
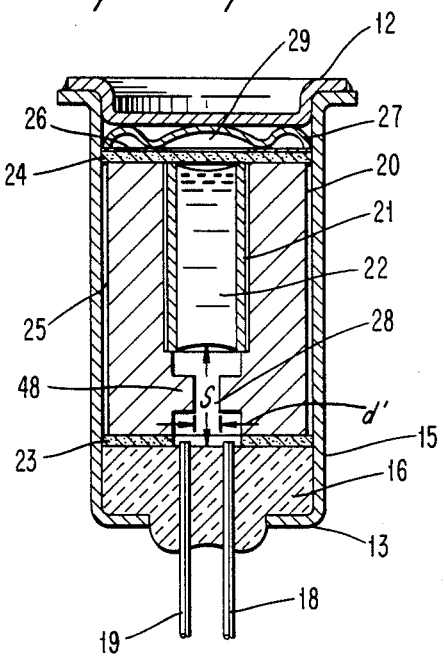
FIG. 5 is a cross-sectional view of a third embodiment of a shock sensor according to the present invention.

Depicted in FIG. 5 is an additional structure for providing a closure delay which involves the provision of a constriction in the travel path of the mercury. In that regard, the cylindrical surface 20B is reduced in diameter to be smaller than the diameter d of the mercury carrier 21. Either the entire surface 20B can display a reduced diameter (not shown), or a separate constriction segment 48 of diameter d' can be incorporated. The surface 20B of reduced diameter or constriction 48 of the cylindrical surface 20B slows or dampens the travel of the mercury 22 by introducing a dash-pot effect and thereby creates an additional delay in the closure time of the sensor 10. The relative diameter d' of the surface 20B is preselected to provide a desired closure delay period in conjunction with the selection of the other parameters of the shock sensor 10, such as the preselected distance S, and/or the extent of compression of the membranes.

Although only certain embodiments are specifically illustrated and described herein, it will be appreciated that many modifications and variations of the present invention are possible in light of the above teachings and within the purview of the appended claims without departing from the spirit and intended scope of the invention. For example, the hold insert 20 may be eliminated by suitably forming the header assembly, comprised of glass bead 16 and can 15, in a manner recessing the contact terminal or terminals by a distance S from the mercury in a bore having the same (or reduced) diameter as the mercury carrier 21. Moreover, instead of forming the surface 21A on a separate carrier 21, the carrier 21 could be eliminated, and the surface 21A formed as a part of the hold insert 20. That surface 21A would then be treated so as to be mercury wettable, or the surface 20B could be treated so as to be mercury-non-wettable if the material of the hold insert is already mercury wettable.

What is claimed is:

1. A shock sensor for sensing shocks, comprising:

a housing;

a container disposed in said housing and having an inner surface;

said inner surface of said container defining an axially extended chamber for containing an electrically conductive fluid;

gas passage means disposed at one end of said chamber, said gas passage means being gas permeable and conductive fluid-non-permeable;

said inner surface of said container including first and second axially adjacent zones, said second zone disposed between said first zone and said gas passage means, said first zone being conductive fluid-wettable and said second zone being conductive fluid-non-wettable, whereby said conductive fluid is normally contained in said first zone when said sensor is free of shocks;

at least one electrically conductive contact terminal disposed in said chamber and arranged to be contacted by said conductive fluid in response to said housing being acted upon by a shock at or above a threshold value, said terminal being spaced axially from said first zone whereby said second zone provides means for delaying contact closure by said conductive fluid.

2. A shock sensor according to claim 1, wherein said gas passage means is defined by a membrane disposed at said one end of said chamber, said membrane being gas permeable and conductive fluid-non-permeable.

3. A shock sensor according to claim 2, wherein said membrane has a preselected degree of gas porosity.

4. A shock sensor according to claim 1, wherein an axial length of said second zone is preselected to provide a preselected delay.

5. A shock sensor according to claim 2, wherein said membrane displays substantially similar porosity in axial and transverse directions.

6. A shock sensor according to claim 1, wherein said conductive fluid is mercury.

7. A shock sensor according to claim 1, wherein said housing is formed of electrically insulative material.

8. A shock sensor according to claim 1 wherein said second zone includes a constriction for inhibiting the travel of said fluid.

9. A shock sensor according to claim 1, wherein said container comprises an insert and a carrier mounted in said insert, said carrier defining said first zone and said insert defining said second zone.

10. A shock sensor according to claim 1, wherein said at least one contact terminal comprises two contact terminals arranged to be directly electrically engaged by said conductive fluid.

11. A shock sensor according to claim 2, wherein said membrane has a pore volume from 40 to 90 percent.

12. A shock sensor according to claim 11, wherein said membrane has a pore diameter from 0.5 to 25 microns.

13. A shock sensor for sensing shocks, comprising:

a housing comprising an outer body, a seal header disposed at a forward axial end thereof, and a cover disposed at a rear axial end thereof, a hold insert mounted in said outer body and including a first inner surface, a carrier mounted in said hold insert and including a second inner surface axially contiguous with said first inner surface and defining a chamber containing a volume of electrically conductive fluid, front and rear gas permeable, conductive fluid-non-permeable membranes disposed at opposite ends of said insert, said front membrane disposed between said hold insert and said seal header, and said rear membrane disposed between said hold insert and said cover, said membranes exhibiting substantially similar permeability in axial and transverse directions and communicating with one another externally of said chamber, said first inner surface disposed between said second inner surface and said front membrane, said second inner surface being conductive fluid-wettable and said first inner surface being conductive fluid-non-wettable, whereby said conductive fluid is normally contained in said second inner surface when said sensor is free of shocks, at least one electrically conductive contact terminal disposed in said chamber and arranged to be contacted by said conductive fluid in response to said housing being acted upon by a shock at or above a threshold value, said terminal being spaced axially from said second inner surface whereby said first inner surface provides means for delaying contact closure by said conductive fluid.

14. The shock sensor of claim 13, wherein the length and diameter of the second inner surface are such that when the shock sensor is at rest, surface tension of the conductive fluid retains the conductive liquid within the second inner surface.

15. The shock sensor of claim 13, wherein an inert gas is sealed within the housing.

16. The shock sensor of claim 13, wherein a tracer gas is sealed within the housing.

17. The shock sensor of claim 13, wherein a mixture of inert gas and tracer gas is sealed within the housing.

18. The shock sensor of claim 13 further comprising passage means between the hold insert and the outer body for interconnecting said membranes.

19. The shock sensor of claim 13, wherein each membrane comprises an elastic organic membrane having a preselected porosity.

20. The shock sensor of claim 13 including compression means for exerting a compressive force on said front membrane to vary the pore size of said front membrane and thereby vary the degree of gas permeability thereof to selectively affect the contact closure delay of said sensor, and for maintaining the spatial relationship of said at least one contact terminal and the hold insert.

21. The shock sensor of claim 20, wherein the compression means includes at least one hold-down washer.

22. The shock sensor of claim 13, wherein the conductive fluid is mercury.

23. A shock sensor according to claim 13 wherein at least part of said first inner surface of said hold insert is narrower than said second surface of said carrier in a direction perpendicular to an axial line of said sensor.

24. A shock sensor according to claim 13, wherein said at least one contact terminal comprises two contact terminals arranged to be directly electrically engaged by said conductive fluid.

25. A method of effecting a time delay in a shock sensor, said method comprises the steps of: disposing a container in a housing, said container having an inner surface which defines an axially extending chamber for containing an electrically conductive fluid; disposing a membrane at one end of said chamber, said membrane being gas permeable and conductive fluid-non-permeable; providing at least a portion of said inner surface of said container that is conductive fluid-wettable, whereby said conductive fluid is normally contained in said chamber when said sensor is free of shocks; disposing at least one electrically conductive contact terminal in said chamber and arranged to be contacted by said conductive fluid in response to said housing being acted upon by a shock at or above a threshold value; and compressing said membrane to change the gas permeability thereof and thereby regulate the rate of travel of said conductive fluid toward said contact terminal.

* * * * *